US008051675B1

(12) United States Patent
Carlson et al.

(10) Patent No.: US 8,051,675 B1
(45) Date of Patent: Nov. 8, 2011

(54) THERMAL SYSTEM

(75) Inventors: Gary Carlson, Aliso Viejo, CA (US); Frank Landon, Santa Ana, CA (US); Joseph Talbert, Murrieta, CA (US)

(73) Assignee: EADS North America, Inc., Irvine, CA (US)

( * ) Notice: Subject to any disclaimer, the term of this patent is extended or adjusted under 35 U.S.C. 154(b) by 397 days.

(21) Appl. No.: 11/603,548

(22) Filed: Nov. 22, 2006

Related U.S. Application Data

(60) Provisional application No. 60/825,576, filed on Sep. 13, 2006.

(51) Int. Cl.
*F25B 43/00* (2006.01)

(52) U.S. Cl. ..... 62/512; 165/104.25

(58) Field of Classification Search ..... 62/512, 62/509, DIG. 2, 291, 207, 214, 261, 188, 62/208; 165/104.25, 104.34, 292
See application file for complete search history.

(56) References Cited

U.S. PATENT DOCUMENTS

| | | | | |
|---|---|---|---|---|
| 4,640,100 | A * | 2/1987 | Goldstein | 62/197 |
| 5,271,239 | A * | 12/1993 | Rockenfeller et al. | 62/259.2 |
| 5,423,190 | A * | 6/1995 | Friedland | 62/149 |
| 5,772,403 | A * | 6/1998 | Allison et al. | 417/44.2 |
| 6,058,775 | A * | 5/2000 | Levy | 73/290 V |
| 6,092,370 | A * | 7/2000 | Tremoulet et al. | 60/328 |
| 6,519,955 | B2 * | 2/2003 | Marsala | 62/119 |
| 6,948,556 | B1 * | 9/2005 | Anderson et al. | 165/80.4 |
| 7,011,143 | B2 * | 3/2006 | Corrado et al. | 165/80.4 |
| 2002/0139136 | A1 * | 10/2002 | Noble, III | 62/473 |

* cited by examiner

*Primary Examiner* — Mohammad Ali

(57) ABSTRACT

A thermal system (100) includes a main pump (104) which pumps refrigerant to a device under test evaporator cluster (124). A system condenser (130) converts the gaseous refrigerant into liquid and the condenser liquid return is provided to a vapor/liquid separation and storage column (142). The thermal system (100) further includes a sump vaporizer (118) which forms part of a sump discharge line loop.

17 Claims, 4 Drawing Sheets

THERMAL SYSTEM

CROSS REFERENCE TO RELATED APPLICATION

This application claims the benefit of U.S. Provisional Application No. 60/825, 576 filed on Sep. 13, 2006.

FIELD OF THE INVENTION

This invention relates to thermal systems such as cooling systems and more particularly to a refrigerant cooling system for use in cooling devices undergoing testing.

BACKGROUND

Designing systems to test large numbers of semiconductor or electronic devices in a factory environment where each individual device under test generates significant thermal load is not a trivial task. Examples of such devices include but are not limited to high-speed microprocessors, laser diodes, and linear high-power amplifiers.

From a semiconductor manufacturers standpoint, factory floor space often comes at a premium. A testing system that is capable of testing the largest number of semiconductor devices in the smallest factory floor footprint is therefore highly desirable. Removing large amounts of heat from high-dissipation devices in a very small footprint is problematic, however. Air-cooling devices undergoing testing require large heat sinks with a corresponding large surface area and size. Water-cooling devices undergoing testing require a lower corresponding heat exchanger area than air, but is still not the smallest solution possible and also has the intrinsic risk of damaging sensitive electronics in the test system should a leak develop.

One solution for cooling heat generating devices utilizes a dual-phase refrigerant where the physical process of evaporation (latent heat of vaporization) absorbs significantly more heat than air or fluid can alone for the same corresponding heat exchanger size. Cooling schemes that depend on either a refrigerant cycle or Carnot heat cycle have long been in existence. Various semiconductor test system manufacturers have used refrigerant cycles wrapped around gas compressors for their central plants.

A key difference between a true refrigerant cycle and a Carnot heat cycle is nothing more than the thermodynamic direction that heat moves: low to high versus high to low. In a refrigerant cycle a compressor takes low pressure gas, compresses it generating high-pressure gas and heat, and then removes the heat in the condenser on the high-pressure side of the system. A Carnot heat cycle on the other hand, uses a fluid pump to pressurize liquid refrigerant into the evaporators. Heat then flashes the liquid refrigerant into gas and then a water sub-cooled condenser downstream condenses refrigerant gas on the low-pressure side of the system to complete the cycle. A classic example of a Carnot heat cycle is a fossil or nuclear-fueled steam power plant generating electricity.

Some of the common problems experienced by current thermal systems used in semiconductor testing environments include refrigerant leaks, poor chiller mean-time-before-failure (MTBF) and inconsistent thermal performance as the device-under-test (DUT)/system thermal load parameters changes. Other problems associated with some thermal systems include the inability to charge the thermal system while the system is operational and the inability to control suction pressure to increase cooling temperature differential.

BRIEF DESCRIPTION OF THE DRAWINGS

The features of the present invention, which are believed to be novel, are set forth with particularity in the appended claims. The invention may best be understood by reference to the following description, taken in conjunction with the accompanying drawings, in the several figures of which like reference numerals identify like elements, and in which:

DETAILED DESCRIPTION

Figure 1:
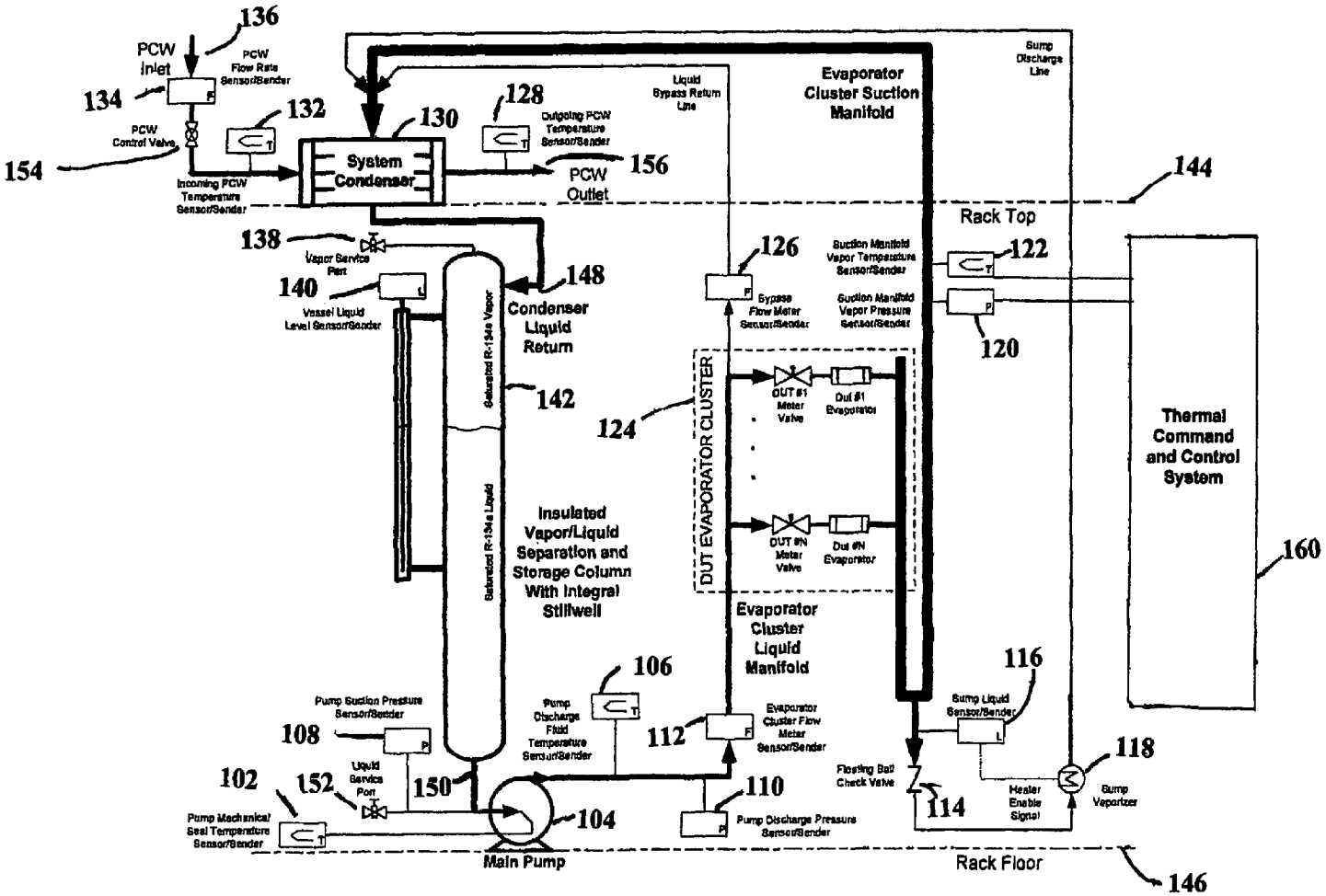
FIG. 1 shows a thermal system in accordance with an embodiment of the invention.

While the specification concludes with claims defining the features of the invention that are regarded as novel, it is believed that the invention will be better understood from a consideration of the following description in conjunction with the drawing figures.

Referring to FIG. 1, there is shown thermal system such as a cooling system 100 in accordance with an embodiment of the invention. Cooling system 100 is a used to cool electronic device(s) undergoing testing also known as device-under-tests or DUTs. In FIG. 1, the DUTs that are undergoing testing are thermally coupled to evaporators each having their own metering valve as shown in DUT evaporator cluster 124. The DUT evaporator cluster 124 includes a plurality of evaporators (DUT #1 to DUT #N) for removing the heat generated by the devices undergoing testing. The evaporators can be the evaporators described in patent application Ser. No. 11/451, 036, filed on Jun. 12, 2006 and entitled "Evaporator" which is hereby incorporated by reference as if fully set forth herein. Each of the evaporators includes a corresponding metering valve (DUT #1 to DUT #N) for controlling the amount of refrigerant provided to each of the evaporators.

The cooling system 100 includes a main liquid refrigerant pump 104. Any liquid pump, whether it be centrifugal, can, magnetic-drive, or positive displacement has a requirement for what is known as NPSH (Net Positive Suction Head). This roughly translates to the minimum height of liquid above the pump inlet that must be maintained during pump operation to prevent internal cavitation that can damage seals, bearings, and impeller surfaces in the pump. In a high-density test rack with an integral internal cooling plant typically found in a semiconductor test station, the ability to satisfy pump NPSH requirements without sacrificing valuable floor space is a real problem. A small, high-volume fluid pump typically requires NPSH in the 4-11 ft range which is impractical for this type of test equipment cooling system. Conversely an oversized pump with large impeller with intake inducer will have NPSH heads as low as 2 feet but are also not space efficient for this particular type of application.

In addition to NPSH concerns, additional features are incorporated in the pump 104. In one embodiment, pump 104 relies on a centrifugal main pump with mechanical seals to move liquid refrigerant. While other types of pumps can be used in this particular application, a centrifugal pump is the least expensive solution to meet the required performance. One problem with using a centrifugal pump is that the mechanical seals in the centrifugal pump are subject to normal wear mechanisms that may lead to leaks and eventually seal failure. Fortunately most degradation in mechanical seals is typically foreshadowed by higher temperatures in the running surfaces of the static and rotating seal halves. Taking advantage of this fact, the improved system preferably uses a pump 104 with integral thermocouples embedded in the mechanical seal surfaces. The seal temperature information is continuously monitored by a thermal command and control system 160 which provides an alarm if necessary. The thermal command and control system 160 which is also referred to as a thermal management computer can include a computer, monitor that allows for the presentation of a graphical user interface (GUI) which can visually show the seal temperatures with the use of a pump mechanical seal temperature sensor/sender 102. The thermal management computer 160 can also include a keyboard for inputting data by a system technician such as entering a pump on or off command, or causing the system to automatically refill the thermal system with refrigerant. The pump temperature sensor/sender 102 is connected to the thermocouples embedded in the pump 104 and transmits the seal temperature information to the thermal management computer 160. The temperature sensor/sender 102 can comprise a hard-wired or wireless unit as are commonly available.

Typical of any thermodynamic cycle, refrigerant liquid that has absorbed heat in the multiple evaporators of the test system 124 and is flashed to gas must be cooled and returned to a liquid for reuse since the system is a closed system. In thermal system 100, condensation is accomplished using a single condenser 130 that exchanges the heat from the refrigerant gas using an external stream of forced air or chilled water. The condenser 130 serves not only to cool the gas back into a liquid, but also as a storage vessel for excess refrigerant. In thermal system 100 pressurized chilled water (PCW) is provided to condenser 130 via inlet 136 which is coupled to a control valve 154. A temperature sensor/sender 132 measures the temperature of the incoming PCW and transmits the information to the thermal management computer 160. A PCW flow rate sensor/sender 134 provides the PCW flow rate information to the thermal management computer 160. The thermal management computer 160 is coupled via wire or wireless to each of the sensor/senders found in thermal system 100.

On the outlet side of the condenser 130 is found another temperature sensor/sender 128 which collects temperature information on the outgoing PCW and submits the temperature information to the thermal management computer 160.

In some prior art cooling systems, the condenser is located at the bottom of the test rack and is used for these same reasons, but also has an additional purpose. Because the condenser liquid refrigerant discharge outlet is directly connected to the inlet of the pump In these prior art systems, the fluid level in the condenser must be at a high enough elevation to satisfy the pump NPSH. This creates several problems; first if the level of the refrigerant in the condenser is high enough to even attempt to partially satisfy the pump's NPSH requirement, the condenser has to be flooded with liquid. This doesn't make for efficient heat transfer of warm gaseous refrigerant since the surface area of the condenser is reduced by the stored liquid. When the system comes out of idle where heat in the system starts generating gaseous refrigerant, the gas has to blow some of the liquid out of the condenser to be able to exchange heat properly. Some systems solve this problem by using a piston-style accumulator to accommodate the displaced refrigerant. This may create a limitless source of refrigerant leaks and system reliability failures as a result of dynamic seal surfaces and complex control systems to manage the accumulator. A second problem is that liquid expelled and accommodated by the accumulator causes the refrigerant level to drop in the condenser—and consequently the available NPSH to the pump also drops. This leads to cavitation problems in the system pump.

In the present invention, the condenser 130 is preferably located at the top of the test rack 144 and has no role in storing liquid refrigerant. This allows the maximum surface area of the condenser 130 to be utilized at all times. Since in the cooling system 100 the condenser 130 no longer serves a role storing liquid refrigerant, the cooling system 100 uses a tall, but narrow vertical cylindrical vessel 142 that can be placed as a down-corner (below the condenser) in the system rack. In one embodiment, the vessel 142 extends from the very bottom of the test rack 146 to nearly the top 144. Unlike a condenser where liquid level determination is very difficult because of internal obstructions, a hollow vessel is quite the opposite. Using either a capacitance rod or float sensor, a fairly precise refrigerant fluid level can be determined using vessel or storage column 142. A vessel liquid level sensor/sender 140 collects the level information from either a capacitance rod or a float sensor and sends the liquid level information to the thermal management computer. A refrigerant output port from the condenser 130 is connected to the refrigerant input port 148 of storage column 142. The refrigerant output 150 of storage column 142 is coupled to the refrigerant input of pump 104. A liquid service port 152 and a vapor service port 138 are coupled to the storage column 142 and are used for maintenance purposes.

Because of a large number of evaporator and manifold seals, refrigerant quick disconnects, and a mechanical pump seal found in these types of systems, small amounts of refrigerant loss occur continuously. Hence with this type of storage scheme, the operator of the system can know exactly when and how much refrigerant replenishment is needed without expensive downtime unloading and recharging the system from scratch or relying on often inaccurate guessing. As an added benefit, with knowledge of the refrigerant levels in the system, the thermal system management computer for the semiconductor test system can calculate the amount of refrigerant needed to top the system off.

Using a metering valve on the liquid service port 152 under the command of the thermal management computer would allow service personnel to attach a tank of refrigerant to the system and automatically recharge the system to the required levels by having the thermal management computer 160 automatically open the metering valve. This could all be accomplished with no more user intervention than attaching and removing the service tank from the semiconductor test system.

In addition to small, on-going refrigerant losses, occasionally system 100 could develop a significant leak that can rapidly deplete refrigerant in an unsupervised test system. With continuous automatic monitoring of refrigerant levels in the system, should a rapid leak develop, the pump 104 can be automatically shutdown by the system before it runs dry and destroys itself. Hence, the cost of the leak doesn't also turn into the cost of additional service downtime and a new pump.

Because of the intrinsic tall vertical height of the vessel 142, the fluid level above the pump inlet is more than sufficient to meet the NPSH requirements of even small, high-flow rate pumps without depending on secondary liquid refrigerant sub-cooling schemes that add complexity and cost. Another benefit of using vessel 142 in this geometry is that it inherits the properties of a distillation column found in a refinery where gravity naturally acts to separate fluid from vapor. This is very good in the sense that fluid will always be at the bottom of the column and vapor at the top. This guarantees that the pump suction intake will draw pure liquid without any entrained gas bubbles. Although these types of bubbles (as opposed to cavitation bubbles) are harmless to the pump, they can cause refrigerant metering errors downstream in the individual evaporators that control device temperature. Additionally, this can also lead to significant variations in pump discharge pressure. The new architecture helps to reduce these problems.

As an attempt to partially solve the NPSH issue and maintain pump discharge pressure, some prior art systems modulate the amount of chilled water coming into the condenser using a complex control scheme and a process control water (PCW) valve. The goal is to maintain a temperature gradient in the condenser where vapor pressure differences between the bottom and top of the condenser creates additional available NPSH—the basic definition of "sub-cooling". This approach tends to work poorly as a result of the operational constraints of most typical semiconductor test systems (i.e. large system thermal load swings, location of condenser, etc.).

One key purpose of a PCW control valve 154 in the existing system is to control external condensation from atmospheric humidity. If the refrigerant liquid is allowed to get too cold in the condenser 130, as it leaves and begins to circulate in exposed manifolds and laminates in high-humidity environments, external dew will potentially condense in undesirable areas of the test system and potentially damage DUTs (e.g., short-circuit them, etc.).

In the thermal cooling plant/system 100, the purpose of the PCW control valve 154 is to keep the liquid refrigerant temperature above the dew point of air surrounding the test system and to prevent external condensation. A PCW flow rate sensor/sender 134 and an incoming PCW temperature sensor/sender 132 are provided to monitor the flow rate and temperature of chilled watering entering the system via PCW inlet 136. Once the PCW has flown through condenser 130 it flows out through PCW outlet port 156.

One of the downsides of limiting the effects of high-humidity environments is that it results in higher low-side pressure in the thermal cycle. Because of intrinsic strength limitations in the laminates that distribute refrigerant from the manifold to the evaporators in the evaporator cluster 124, the maximum design pressure of the system in one embodiment is about 130 PSIG. Since pump discharge pressure is the sum of suction and discharge head pressures, the low-side pressure can't come up too far or the laminate pressure will approach its design limit. To provide extra monitoring by the system's controller, a suction manifold vapor temperature sensor/sender 122 and a suction manifold vapor pressure sensor/sender 120 monitor the manifold temperature and pressure.

The multiple advantages of having the condenser 130 located at the top of the test rack 144 have already been enumerated. One complication results from this however. Because the vaporized refrigerant exiting the evaporators will lose some heat to the surroundings prior to reaching the condenser 130 and transition back to a liquid, a dry suction (return) manifold will eventually flood as liquid accumulates. Left unchecked, this has the potential to eventually flood the lowest-lying evaporators in the rack and cause performance problems. There are several different ways this problem can be handled. The schemes that could be used include using a powered pump, venturi-type liquid aspirator pump, or a fluid vaporizer installed at the lowest elevation of the suction manifold.

Mechanical, powered pumps work well, but add complexity and extra failure modes to the system because of moving parts. A venturi-type liquid aspirator has the advantage of no moving parts but requires some of the main pump's output flow to be channeled through the aspirator to create suction. A good solution for the problem for the cooling system 100 is to use a fluid sump vaporizer 118.

The fluid sump vaporizer 118 is implemented by placing a valve 114 feeding a small evaporating chamber in the sump vaporizer 118 below the lowest level of the suction manifold. When liquid starts to accumulate in the suction manifold, it will fall by gravity through the check valve 114 into the chamber where a small heating element will vaporize the liquid. The gas generated in this chamber won't be able to go back against the check valve 114 and instead will push liquid slugs of refrigerant up to the highest point in the system (the condenser) through a small-diameter discharge tube (sump discharge line). As the liquid level falls in the vaporization chamber, the check valve 114 will fall open allowing fluid to fall back into the chamber where the process will repeat. When no liquid remains in the sump 118, the sump liquid sensor/sender 116 will no longer detect fluid and will shut off heat to the vaporizer 118.

Thermal system 100 uses a variable frequency drive (VFD) to speed or slow the pump to control system high-side pressure. By using a pressure sensor/sender 110 on the discharge side of the pump and feeding its data into the VFD with a control loop, it is possible to guarantee a stable pressure. Having a stable system pressure is actually quite important. Since each evaporator in evaporator cluster 124 has a metering valve with a control loop that is closed around temperature these individual control loops are only independent of each other if the inlet and outlet pressures are stable. Using a VFD to control system pressure is not the only exclusive way of regulating pressure. As an alternate approach, the pump 104 could be operated at a stable speed and in conjunction with a back-pressure valve to regulate system pressure.

A pump discharge fluid temperature sensor/sender 106 keeps track of the pump's discharge fluid temperature while an evaporator cluster flow meter sensor/sender 112 keeps track of the flow rate flowing into evaporator cluster 124. All of the sensor/senders of the thermal system 100 communicate with the thermal management computer 160 in order for the system to monitor all relevant information of the system.

Figure 2:
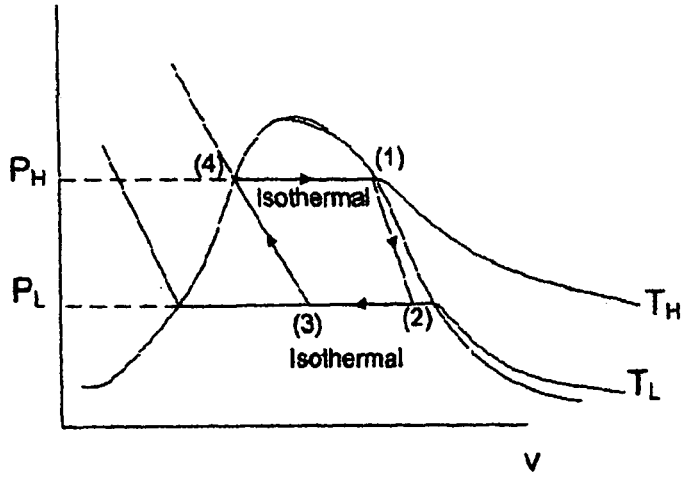
FIG. 2 shows a thermal cycle in accordance with an embodiment of the invention.
Figure 3:
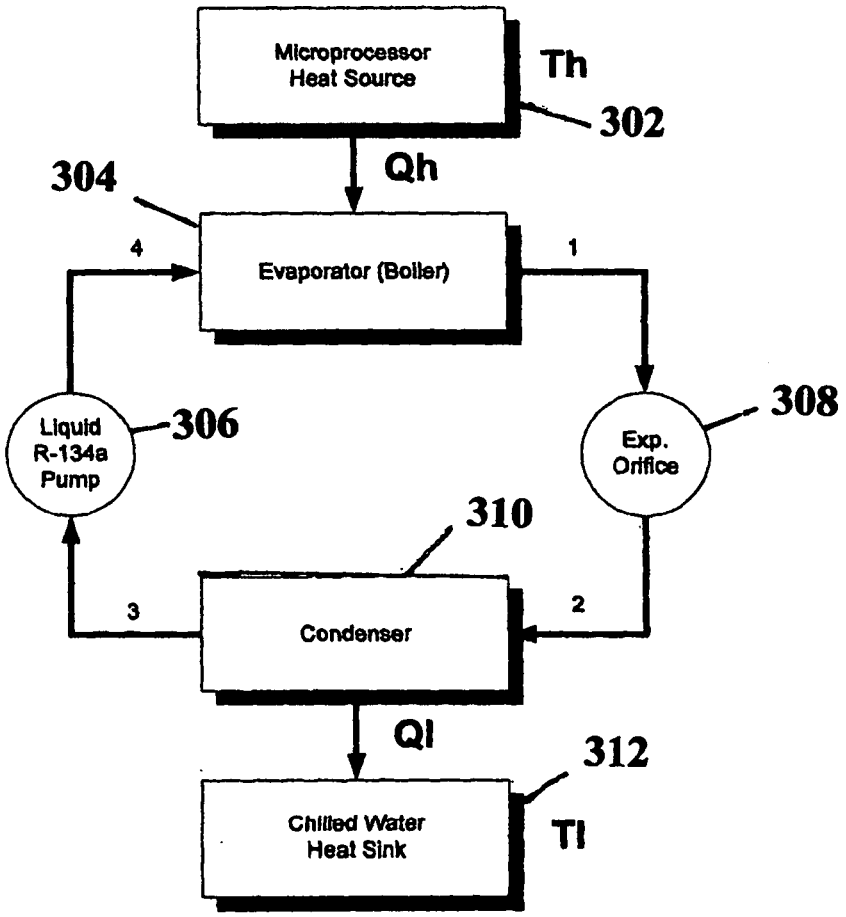
FIG. 3 shows a flowchart highlighting some of the steps taken in accordance with an embodiment of the invention.

In FIG. 2 there is shown a heat cycle state diagram highlighting the different states of the thermal system 100. From state 4 to state 1 isothermal evaporation occurs, while from state 1 to state 2, adiabatic expansion occurs. From state 2 to state 3 isothermal condensation occurs, while from state 3 to 4 adiabatic compression occurs. Referring to FIG. 3 there is shown a flow diagram highlighting the thermal cycle of thermal system 100. In 302, heat is generated from a DUT such as a microprocessor, the evaporator 304 which is pressed against the particular DUT Is provided liquid refrigerant such as R-134a using pump 306. When presented with the heat generated by the heat source the liquid refrigerant is converted into a gas and sent to the orifice 308. The gas Is then sent through the condenser 310 which using its chilled water heat sink 312 returns the gas state refrigerant into a liquid and the cycle is repeated.

Figure 4:
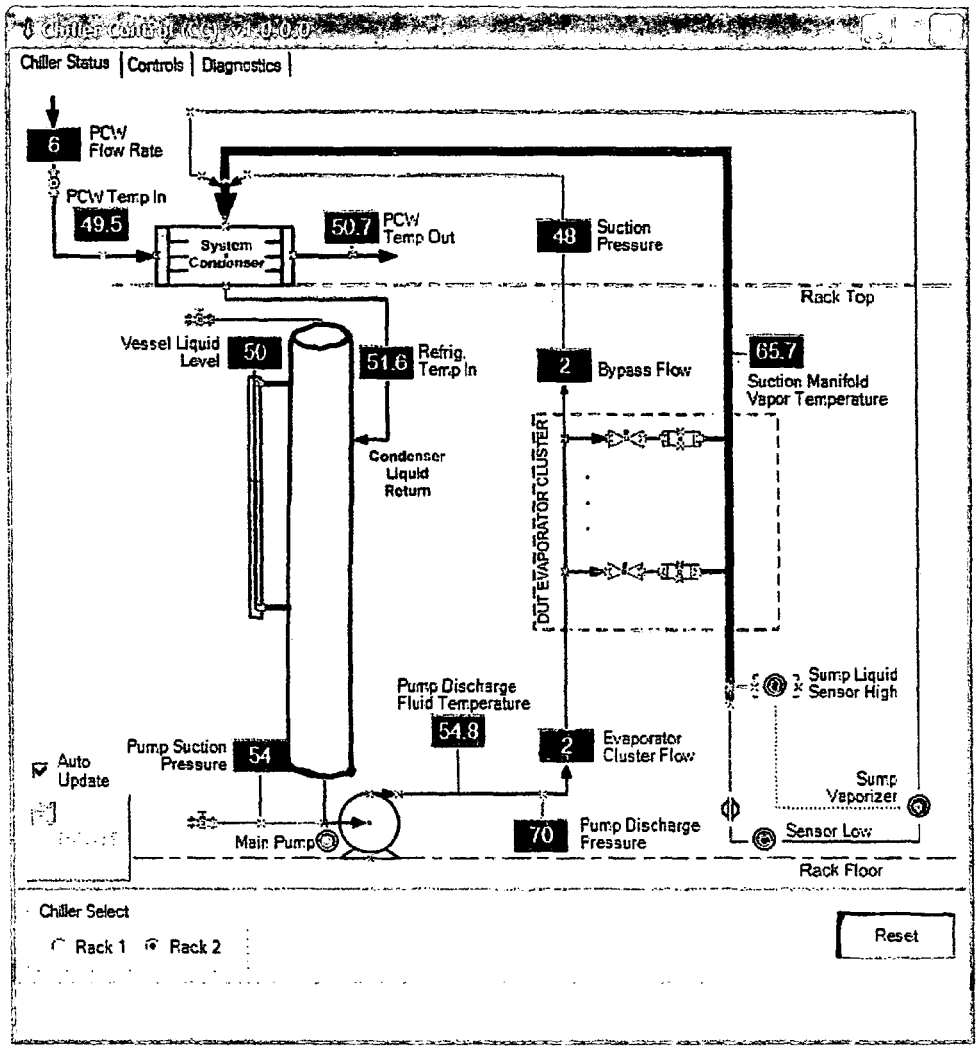
FIG. 4 shows a GUI for the thermal system in accordance with an embodiment of the invention.
Figure 5:
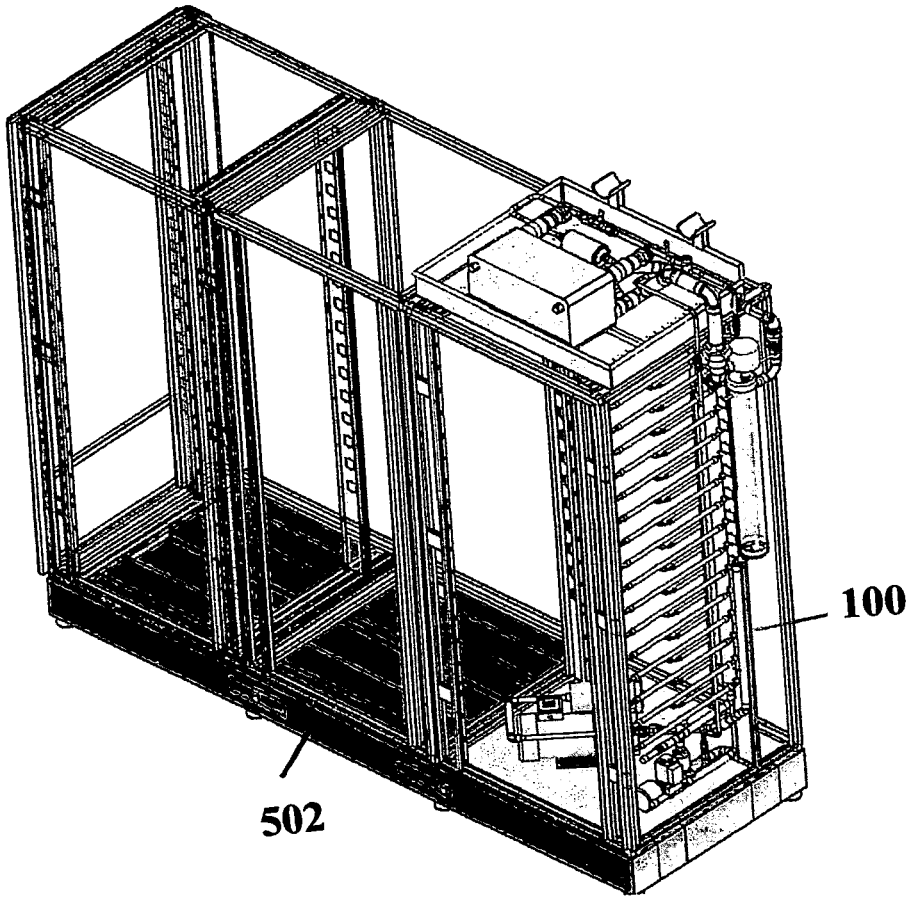
FIG. 5 shows a placement of a thermal system in a test rack in accordance with an embodiment of the invention.

In FIG. 4 there is shown a screen shot of the GUI for the thermal management computer. The GUI provides information on the entire thermal system 100 including the refrigerant level, volume flow, pressures and temperatures at different locations in the system as will as the PCW volume flow and temperatures. Using this graphical interface allows the system technician to quickly monitor system performance. As previously mentioned, the system can also provide for automatic refrigerant refilling based on present levels that can be programmed into the system. The system can also be set up so that it can automatically shut-off the pump or entire system if it detects a major leak or certain parameters reach predetermined levels. Referring to FIG. 5, there is shown the placement of the thermal system 100 in a test system rack 502.

While the preferred embodiments of the invention have been illustrated and described, it will be clear that the invention is not so limited. Numerous modifications, changes, variations, substitutions and equivalents will occur to those skilled in the art without departing from the spirit and scope of the present invention as defined by the appended claims.

What is claimed is:

1. A thermal system, comprising:

a test system rack having a top and a floor;

a pump for pumping refrigerant and located near the floor of the test system rack;

an evaporator cluster having at least one input port coupled to the pump for receiving the refrigerant;

a condenser located at the top of the test system rack, the condenser having an input port coupled to the evaporator cluster for receiving a portion of the refrigerant that is pumped by the pump and including an output port; the condenser is not used to store the refrigerant; and a vapor and liquid separation storage column located below the condenser, extending substantially from the top to the floor of the test system rack, and coupled between the condenser and pump and including a refrigerant input port directly coupled to the condenser output port, the vapor and liquid separation storage column including a refrigerant output port directly connected to an input port of the pump for providing the refrigerant in a liquid state to the pump.

2. A thermal system as defined in claim 1, wherein the vapor and liquid separation storage column is located physically above the pump.

3. A thermal system as defined in claim 2, wherein the evaporator cluster comprises a plurality of evaporators each having a corresponding metering valve for controlling the amount of refrigerant provided to each of the plurality of evaporators.

4. A thermal system as defined in claim 2, wherein the evaporator cluster includes at least one output port coupled to a sump vaporizer.

5. A thermal system as defined in claim 4, wherein the sump vaporizer vaporizes any refrigerant provided from the at least one output port of the evaporator cluster and provides the vaporized refrigerant to the condenser input port.

6. A thermal system as defined in claim 1 further comprises a pump seal temperature sensor for measuring the temperature of seals located within the pump.

7. A thermal system as defined in claim 6, further comprising a thermal management computer coupled to the pump seal temperature sensor for receiving the temperature of the pump seals provided by the pump seal temperature sensor.

8. A thermal system as defined in claim 7, wherein the thermal management computer determines when the pump seals need to be replaced.

9. A thermal system as defined in claim 7, wherein the vapor and liquid separation storage column includes a vessel liquid level sensor coupled to the thermal management computer, the vessel liquid level sensor provides information on the amount of liquid refrigerant stored within the vapor and liquid storage column to the thermal management computer.

10. A thermal system as defined in claim 1, further comprising:

a pump suction pressure sensor;

a pump discharge pressure sensor;

a pump discharge fluid temperature sensor; and a thermal management computer coupled to the pump suction pressure sensor, the pump discharge pressure sensor and the pump discharge fluid temperature sensor.

11. A system for cooling devices undergoing testing, comprising:

a test system rack having a top and a floor;

an evaporator cluster including a plurality of evaporators used in cooling the devices undergoing testing;

a pump for pumping refrigerant to the evaporator cluster located near the floor of the test system rack;

a condenser located at the top of the test system rack and above the evaporator cluster, the condenser having an input port coupled to the evaporator cluster for receiving a portion of the refrigerant that is pumped by the pump through the evaporator cluster and including an output port, the condenser is not used to store the refrigerant; and a vapor and liquid separation and storage tank, extending substantially from the top to the floor of the test system rack, and including a refrigerant input port directly coupled to the condenser output port for collecting refrigerant that has been condensed by the condenser, the vapor and liquid separation and storage tank including a refrigerant output port directly connected to an input port of the pump for providing refrigerant in a liquid state to the pump.

12. A system as defined in claim 11, further comprising a sump vaporizer coupled to the evaporator cluster.

13. A system as defined in claim 12, further comprising a thermal management computer and a sump liquid sensor and the thermal management computer based on information provided by the sump liquid sensor automatically turns on a heater located in the sump vaporizer.

14. A system for cooling devices undergoing testing, comprising:

a test system rack having a top and a floor;

an evaporator cluster including a plurality of evaporators used in cooling the devices undergoing testing;

a pump for pumping refrigerant to the evaporator cluster located near the floor of the test system rack;

a condenser located at the top of the test system rack and above the evaporator cluster, the condenser having an input port coupled to the evaporator cluster for receiving the refrigerant that is pumped by the pump through the evaporator cluster and including an output port, the condenser is not used to store the refrigerant;

a vapor and liquid separation and storage tank, extending substantially from the top to the floor of the test system rack, and including a refrigerant input port directly connected to the condenser output port for collecting refrigerant that has been condensed by the condenser, the vapor and liquid separation and storage tank including a refrigerant output port directly coupled to an input port of the pump for providing refrigerant in a liquid state to the pump; and a liquid service port coupled to the refrigerant output port of the vapor and liquid separation and storage tank for recharging the refrigerant to a required level.

15. A system for cooling devices undergoing testing as defined in claim 14, further comprising:

a metering valve coupled to the liquid service port; and a thermal management computer coupled to the metering valve for automatically recharging the refrigerant to the required level.

16. A system for cooling devices undergoing testing as defined in claim 15, further comprising:

a Pressurized Chilled Water (PCW) control valve coupled to the condenser and coupled to the thermal management computer for controlling the temperature of the refrigerant in the condenser by controlling the amount of PCW flowing through the condenser.

17. A system for cooling devices undergoing testing as defined in claim 16, wherein the thermal management computer controls the PCW control valve in order to keep the refrigerant temperature in the condenser above the dew point of the air surrounding the system in order to prevent external condensation.

* * * * *